United States Patent [19]

McKinney

[11] 4,257,561

[45] Mar. 24, 1981

[54] CHILD-RESISTANT DISPENSING NOZZLE ASSEMBLY

[75] Inventor: James C. McKinney, Alpharetta, Ga.

[73] Assignee: Ethyl Products Company, Richmond, Va.

[21] Appl. No.: 45,637

[22] Filed: Jun. 5, 1979

[51] Int. Cl.[3] ..... B05B 1/30

[52] U.S. Cl. ..... 239/581; 215/216; 222/153; 222/402.11; 222/407

[58] Field of Search ..... 222/153, 402.11, 407; 215/209, 216; 239/581

[56] References Cited

U.S. PATENT DOCUMENTS

| | | | |
|---|---|---|---|
| 3,913,803 | 10/1975 | Laauwe | 222/402.11 |
| 4,024,988 | 5/1977 | Starrett | 222/402.11 X |
| 4,036,385 | 7/1977 | Morris | 215/209 |
| 4,099,639 | 7/1978 | Boxer | 215/209 |
| 4,161,288 | 7/1979 | McKinney | 239/333 |

*Primary Examiner*—Richard A. Schacher

*Attorney, Agent, or Firm*—Donald L. Johnson; John F. Sieberth; David L. Ray

[57] ABSTRACT

A child-resistant nozzle connectable to a spray dispensing device. The child-resistant nozzle assembly of the present invention includes a nozzle having a slot in the upstream end for receipt of a lug connected to the pump body. The lug may be depressed by the fingers of the user to selectively engage or disengage the slot in the nozzle. When the lug is engaged in the slot in the nozzle, no liquids can leak or be dispensed from the nozzle.

7 Claims, 9 Drawing Figures

CHILD-RESISTANT DISPENSING NOZZLE ASSEMBLY

BACKGROUND OF THE INVENTION

This invention relates to hand actuated pump dispensers and more particularly to a nozzle which can be closed to prevent liquids from being dispensed therefrom and which is difficult for a child to remove. Containers which are difficult for a child to open are commonly referred to as being "child-resistant".

Fluid pump dispensers are generally provided with a nozzle structure including a check valve for blocking communication between the pump chamber and a nozzle aperture. A nozzle structure of this type is illustrated in U.S. Pat. No. 3,685,739 and U.S. Pat. No. 3,061,202. Other check valves for use in mechanisms for spraying fluids are shown in U.S. Pat. No. 2,805,891, U.S. Pat. No. 3,187,960, and U.S. Pat. No. 4,013,229.

Typically, fluid is discharged from a spray dispenser by reducing the volume of a pump chamber, thereby opening a pressure responsive outlet check valve. In conventional spray dispensers the volume of the pump chamber may be varied by operating a piston, as illustrated in U.S. Pat. No. 3,840,157, or the volume of the pump chamber may be varied by flexing a wall of a flexible tubular member, having an integral valve therewith as illustrated in U.S. Pat. No. 3,749,290.

An example of the type of spray dispensing device to which the present invention relates is disclosed in U.S. Pat. No. 3,685,739. In such a spray dispensing device the nozzle is rotated on threads until the valve is closed tightly to seal off fluid passageways so that inadvertant or malicious operation of the trigger will not eject fluids from the nozzle orifice. Further, the container can be turned upside down or laid on its side and no liquid will be lost through the nozzle.

Some of the nozzles of the prior art which can be screwed on tightly to seal the nozzle from leakage suffer from the disadvantage that they may be removed by a young child, i.e., they are not child-resistant. It is thus desirable that there be provided a nozzle which can be screwed onto a spray dispensing device tightly to seal the nozzle and which may not be easily removed by a child.

SUMMARY OF THE INVENTION

In accordance with the present invention there is provided a child resistant nozzle connectable to a spray dispensing device. The child-resistant nozzle assembly of the present invention includes a nozzle having a slot in the upstream end for receipt of a lug connected to the pump body. The lug may be depressed by the fingers of the user to disengage the slot in the nozzle. When the lug is engaged in the slot in the nozzle, no liquids can leak or be dispensed from the nozzle.

DESCRIPTION OF THE PREFERRED EMBODIMENTS

It is to be understood in the following description of the invention that any conventional type of fluid dispensing device or pump may be used to supply fluids to the nozzle of the invention. Although the invention has particular application to hand actuated pump dispensers, it can also be used on aerosol dispensers or other pressurized dispensers as will be obvious to those skilled in the art.

Figure 1:
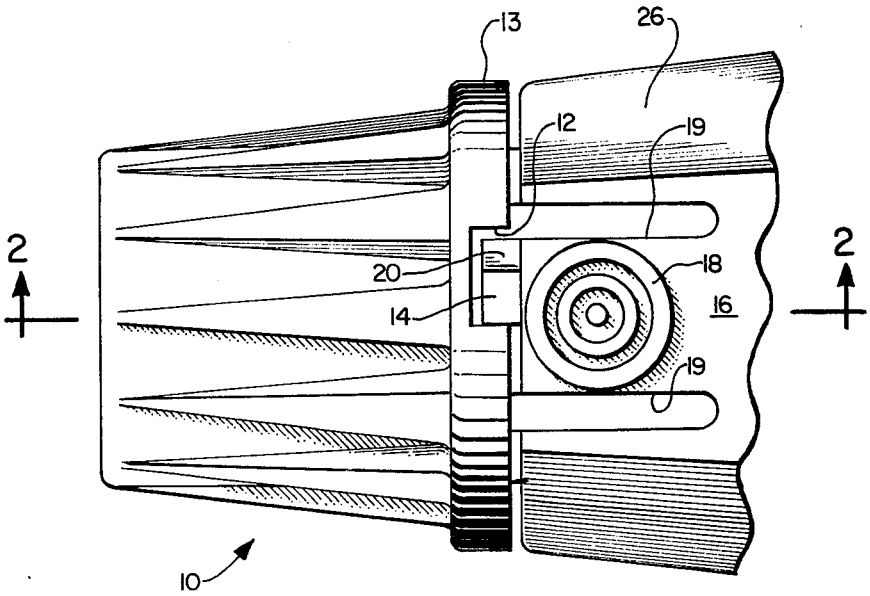
FIG. 1 is a top, partly cut-away plan view of the nozzle and pump body of the present invention showing the nozzle in the closed, non-dispensing mode.

Referring now to the drawings, and in particular to FIG. 1, there is shown a nozzle generally indicated by the numeral 10, having a slot 12 in the upstream, circular collar 13 for receipt of lug 14. Lug 14 is integrally molded with flexible member 16 having a raised button portion 18 which the user depresses with the finger or thumb. Two slots 19—19 separate the sides of button 18 and lug 14 from pump body 26 to allow easy depression of button 18.

Lug 14 has a tapered portion 20 thereon which allows the nozzle 10 to be screwed onto housing 22 which is provided by means of threads 24 without having to depress button 18. Button 18 is connected to the pump body 26. If desired, the pump housing 22 and pump body 26 may be molded integrally or connected together by other means such as snapping or gluing, for example, as is well known in the art.

Figure 2:
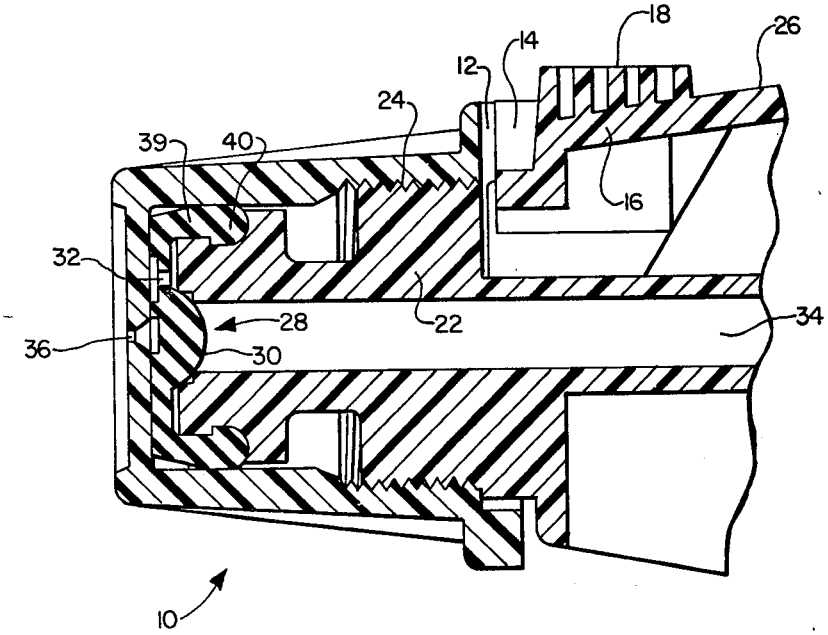
FIG. 2 is a cross-sectional, partly cut-away view of the nozzle and pump body of the present invention taken along lines 2—2 of FIG. 1 showing the nozzle in the closed, non-dispensing mode.
Figure 3:
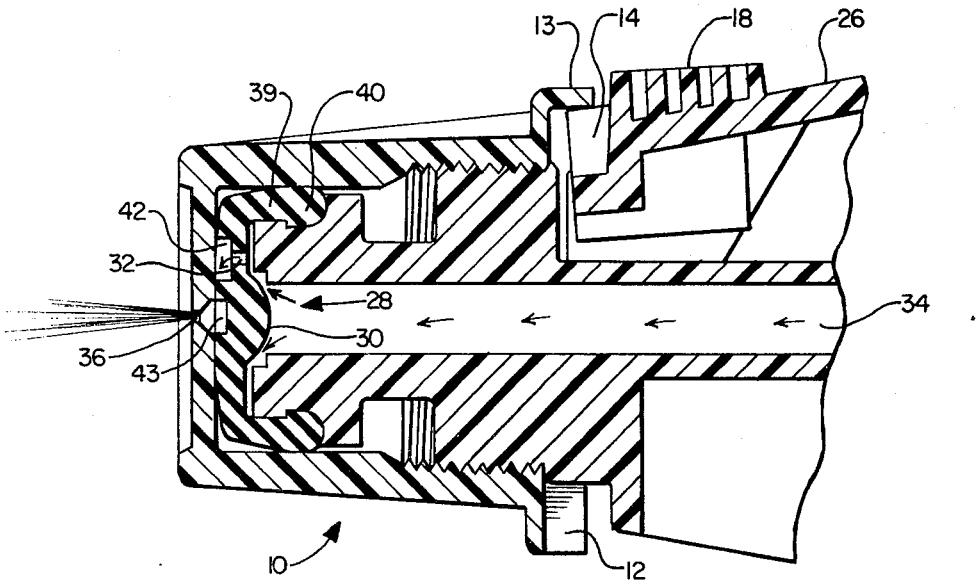
FIG. 3 is a cross-sectional, partly cut-away view of the nozzle and pump body of the present invention taken along lines 2—2 of FIG. 1 with the exception that the nozzle has been rotated to the dispensing mode.
Figure 9:
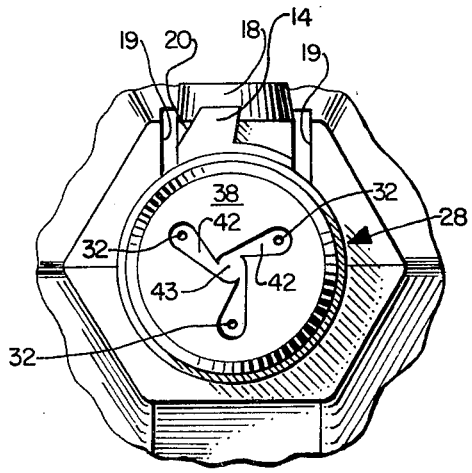

Mounted on the end of housing 22 is a flexible outlet member, generally indicated by the numeral 28 in FIGS. 2, 3, 8, and 9. As shown in FIGS. 2, 3, and 9, flexible valve member 28 has a central, generally hemispherical portion 30 surrounded by apertures 32. The apertures 32 provide fluid flow passages between the outlet conduit 34 and the aperture 36 in nozzle 10 when flexible outlet valve 28 is open.

Extending from the face portion 38 of flexible outlet valve 28 is peripheral edge 39 which extends at a generally right angle to face portion 38 toward body 26. Attached to peripheral edge 39 is an O-ring portion 40.

Located on the face 38 of flexible valve member 28 are a series of channels 42 which convey liquid from apertures 32 when the pump is in the dispensing mode as shown in FIG. 3 to a central discharge chamber 43 from which the fluids exit through aperture 36 of nozzle 10.

Figure 6:
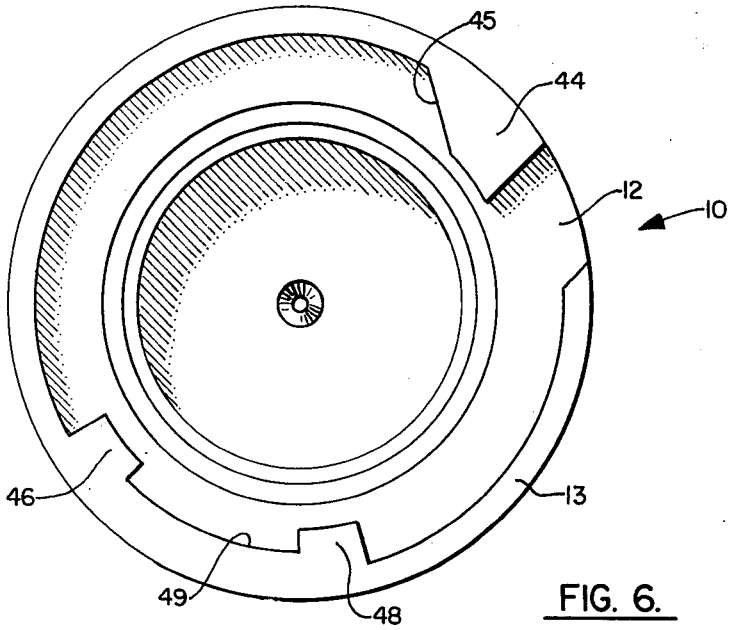
FIG. 6 is a plan view of the nozzle taken from the upstream end looking downstream.
Figure 7:
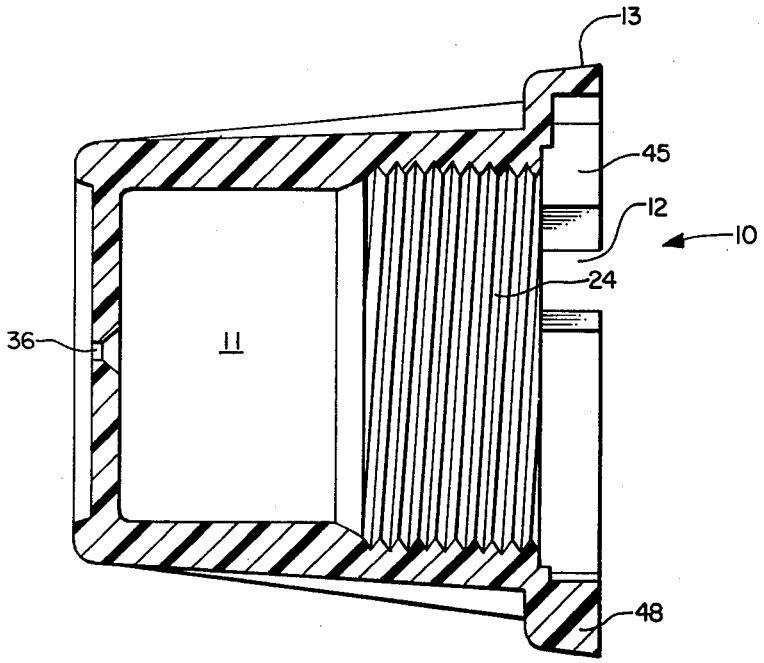
FIG. 7 is a cross-sectional view of the nozzle of the present invention.
Figure 8:
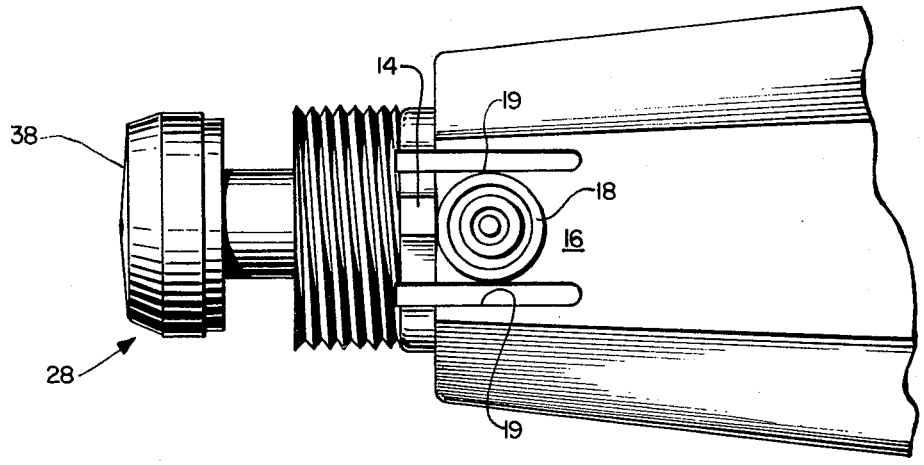
FIG. 8 is a top plan view of the pump housing and pump body of the present invention with the nozzle removed; and, FIG. 9 is a front, partly cut-away view of the pump housing of the present invention with the nozzle removed.

Nozzle 10 is shown in greater detail in FIGS. 6 and 7. As can be seen in the drawings, nozzle 10 has a hollow cavity 11 therein for receipt of housing 22. Adjacent to slot 12 on nozzle 10 is a lug 44 having a tapered portion 45 thereon. Tapered portion 45 of lug 44 cooperates with the tapered portion 20 of lug 14 to allow the nozzle 10 to be screwed easily onto threads 24. Also located on the inside of nozzle 10 as shown in FIG. 6 are two detents 46 and 48 having a slot 49 therebetween. Detent 46 will strike lug 14 when nozzle 10 is rotated to stop the nozzle in the dispensing mode. Slot 49 could be raised to the height of detents 46 and 48 if desired since detent 46 stops the rotation of nozzle 10.

Figure 4:
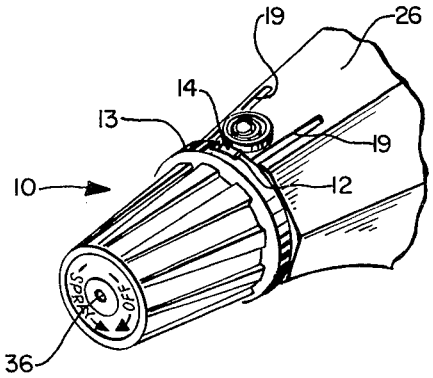
FIG. 4 is a perspective view of the nozzle of the present invention wherein the lug is engaged in the slot.

In FIGS. 1, 2, and 4, the nozzle is in the non-dispensing position. The nozzle 10 has been screwed onto housing 22 and pump body 26 until the nozzle is tight on the pump body thereby forcing hemispherical portion 30 against the end of conduit 34 to shut off the flow of fluid from conduit 34. As shown in FIG. 4, the button 18 has been released and lug 14 is located in slot 12.

Figure 5:
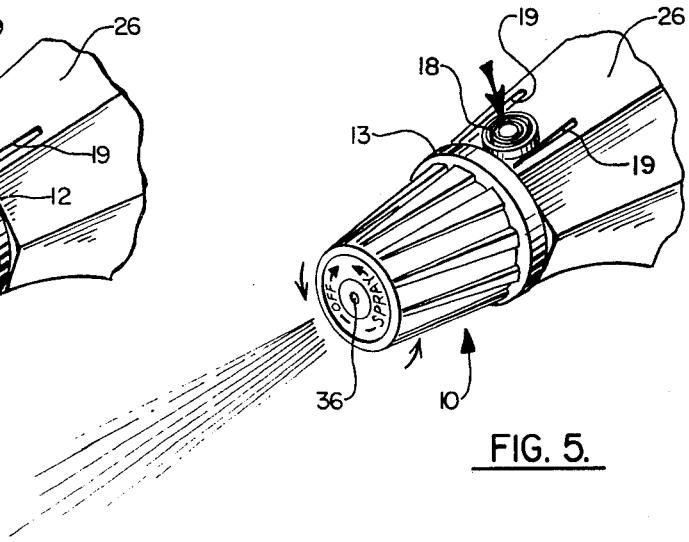
FIG. 5 is a perspective view of the nozzle of the present invention wherein the lug is desengaged from the slot and the nozzle is spraying fluid.

Referring now to FIGS. 3 and 5, to place the nozzle in the operating mode, it is necessary to depress button 18 as shown by the arrow in FIG. 5 sufficiently to move lug 14 downwardly from slot 11 beneath collar 13. Nozzle 10 is then rotated counterclockwise when looking at the nozzle from the discharge end until lug 14 strikes, and is stopped by detent 46. Such a position is shown in cross-section in FIG. 3. As can be seen in FIG. 3, the hemispherical portion 30 is now removed from the end of conduit 34 and liquids can flow in the direction indicated by the arrows through conduit 34, apertures 32, channels 42, central channel 43, and outwardly through aperture 36.

Although the preferred embodiments of the present invention have been disclosed and described in detail above, it should be understood that the invention is in no sense limited thereby and its scope is to be determined by that of the following claims.

What is claimed:

1. A child-resistant nozzle assembly for a liquid dispenser comprising:

a. nozzle means having a downstream end and an upstream end and being generally hollow inside, said nozzle means having slot means in the upstream end, said nozzle means having thread means thereon which engage thread means on said body means for connecting said nozzle means to said body means;

b. dispenser body means connectable to said nozzle means having lug means flexibly connected thereto for selective receipt within said slot means to prevent said nozzle means from turning when said lug means is received in said slot means;

c. conduit means in said dispenser body means for supplying liquids to said nozzle means; and, d. flexible valve means located between said nozzle means and said conduit means.

2. The child resistant nozzle assembly of claim 1 wherein said nozzle means has detent means on the inside for striking said lug means to stop the rotation of said nozzle means when said lug means is removed from said slot means and said nozzle is rotated.

3. The child-resistant nozzle assembly of claim 1 wherein said nozzle means is adapted to force said valve means to close said conduit means to prevent liquids from escaping from said nozzle means when said lug means is received in said slot means.

4. The child-resistant nozzle assembly of claim 3 wherein said flexible valve means has a generally hemispherical portion which contacts said conduit means and a series of apertures therein through which fluids can flow when said valve is in the open position.

5. The child-resistant nozzle assembly of claim 4 wherein said lug means has one tapered edge.

6. The child-resistant nozzle assembly of claim 5 wherein said slot means has a tapered portion which cooperates with said tapered edge to enable said nozzle means to be threaded onto said body means without manually depressing said button means.

7. The child-resistant nozzle assembly of claim 1 wherein button means for depressing said lug means is connected to said lug means.

* * * * *

REEXAMINATION CERTIFICATE (27th)

United States Patent [19]

McKinney

[11] B1 4,257,561

[45] Certificate Issued Oct. 26, 1982

[54] CHILD-RESISTANT DISPENSING NOZZLE ASSEMBLY

[75] Inventor: James C. McKinney, Alpharetta, Ga.

[73] Assignee: Ethyl Products Company, Richmond, Va.

Reexamination Request

No. 90/000,045, Aug. 4, 1981

Reexamination Certificate for:

Patent No.: 4,257,561
Issued: Mar. 24, 1981
Appl. No.: 45,637
Filed: Jun. 5, 1979

[51] Int. Cl.[3] ..... B05B 1/30

[52] U.S. Cl....239/58; 215/216; 222/153; 222/402.11; 222/407

[58] Field of Search...222/153, 402.11, 407; 215/209, 215/216; 239/581, 333, 533.1

[56] References Cited

U.S. PATENT DOCUMENTS

| | | | |
|---|---|---|---|
| 3,131,646 | 5/1964 | Parrott. | |
| 3,187,960 | 6/1965 | Gorman | 222/321 |
| 3,685,739 | 8/1972 | Vanier | 239/333 |
| 3,700,133 | 10/1972 | Bugguley | 215/9 |
| 3,913,803 | 10/1975 | Laauwe | 222/402.11 |
| 3,913,804 | 10/1975 | Laauwe | 222/402.11 |
| 3,984,021 | 10/1976 | Uhlig | 215/216 |
| 4,024,988 | 5/1977 | Starrett | 222/402.1 |
| 4,036,385 | 7/1977 | Morris | 215/209 |
| 4,099,639 | 7/1978 | Boxer et al | 215/209 |
| 4,161,288 | 7/1979 | McKinney | 239/333 |
| 4,204,614 | 5/1980 | Reeve | 222/153 |

FOREIGN PATENT DOCUMENTS

| | | |
|---|---|---|
| 208975 | | Argentina. |
| 2042690 | 3/1972 | Fed. Rep. of Germany. |
| 710583 | 6/1954 | United Kingdom. |
| 1312017 | 4/1975 | United Kingdom. |

*Primary Examiner*—Andres Kashnikow

[57] ABSTRACT

A child-resistant nozzle connectable to a spray dispensing device. The child-resistant nozzle assembly of the present invention includes a nozzle having a slot in the upstream end for receipt of a lug connected to the pump body. The lug may be depressed by the fingers of the user to selectively engage or disengage the slot in the nozzle. When the lug is engaged in the slot in the nozzle, no liquids can leak or be dispensed from the nozzle.

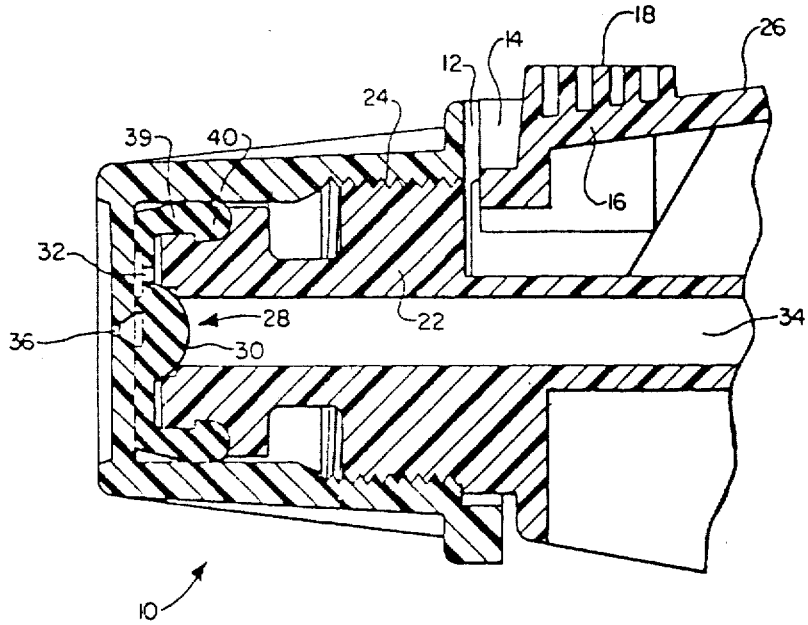

REEXAMINATION CERTIFICATE ISSUED UNDER 35 U.S.C. 307.

THE PATENT IS HEREBY AMENDED AS INDICATED BELOW.

Matter enclosed in heavy brackets appeared in the patent, but has been deleted and is no longer a part of the patent; matter printed in italics indicates additions made to the patent.

AS A RESULT OF REEXAMINATION, IT HAS BEEN DETERMINED THAT:

Claim 3, having been finally determined to be unpatentable is cancelled.

Claims 1, 4, and 6 are determined to be patentable as amended:

1. A child-resistant nozzle assembly for a liquid dispenser comprising:

a. nozzle means having a downstream end and an upstream end and being generally hollow inside, said nozzle means having slot means in the upstream end, said nozzle means having thread means thereon which engage thread means [on said] *provided on a dispenser* body means for connecting said nozzle means to said *dispenser* body means;

b. *said* dispenser body means [connectable to said nozzle means] having lug means flexibly connected thereto for selective receipt within said slot means to prevent said nozzle means from turning when said lug means is received in said slot means;

c. conduit means in said dispenser body means for supplying liquids to said nozzle means; and d. flexible valve means located between said nozzle means and said conduit means[.], *said valve means being adapted to make contact with said nozzle means to force said valve means to close said conduit means to prevent liquids from escaping from said nozzle means when said lug means is received in said slot means.*

4. The child-resistant nozzle assembly of claim [3] *1* wherein said flexible valve means has a generally hemisperical portion which contacts said conduit means and a series of apertures therein through which fluids can flow when said valve is in the open position.

6. The child-resistant nozzle assembly of claim 5 wherein said slot means has a tapered portion which cooperates with said tapered edge to enable said nozzle means to be threaded onto said body means without manually depressing said [button means] *lug means.*

Claims 2, 5, and 7, dependent on amended claims, are determined to be patentable.

* * * * *